US009352206B2

(12) United States Patent
Uehling, III

(10) Patent No.: US 9,352,206 B2
(45) Date of Patent: May 31, 2016

(54) VIDEO-BASED SYSTEM FOR TENNIS TRAINING INCORPORATING MATS

(76) Inventor: Gordon A. Uehling, III, Cresskill, NJ (US)

( * ) Notice: Subject to any disclaimer, the term of this patent is extended or adjusted under 35 U.S.C. 154(b) by 54 days.

(21) Appl. No.: 12/623,213

(22) Filed: Nov. 20, 2009

(65) Prior Publication Data

US 2011/0124444 A1 May 26, 2011

(51) Int. Cl.

*A63B 69/38* (2006.01)
*A63B 71/06* (2006.01)
*A63B 24/00* (2006.01)

(52) U.S. Cl.

CPC ..... *A63B 69/38* (2013.01); *A63B 71/0619* (2013.01); *A63B 2024/0012* (2013.01); *A63B 2220/806* (2013.01); *A63B 2220/807* (2013.01); *A63B 2220/89* (2013.01)

(58) Field of Classification Search

CPC ..... A63B 69/00; A63B 69/0002; A63B 69/0008; A63B 69/38; A63B 69/385; A63B 71/0619; A63B 2024/0012; A63B 2220/806; A63B 2220/807; A63B 2220/89

USPC ..... 473/459, 422, 415, 452, 453; 434/250

See application file for complete search history.

(56) References Cited

U.S. PATENT DOCUMENTS

| | | | | | |
|---|---|---|---|---|---|
| 233,482 | A * | 10/1880 | De Long | 283/117 |
| 1,815,443 | A * | 7/1931 | Mitchell | 434/250 |
| 2,901,838 | A * | 9/1959 | Bovie | 434/250 |
| 2,913,835 | A * | 11/1959 | Montine | 434/250 |
| 2,988,825 | A * | 6/1961 | Wilson | 434/250 |
| 4,023,798 | A * | 5/1977 | Pronin | 473/462 |
| 4,932,656 | A * | 6/1990 | Pierce | 473/452 |
| 5,011,143 | A * | 4/1991 | Jones | 473/459 |
| 5,330,176 | A * | 7/1994 | Cagney, Jr. | 473/452 |
| 6,102,818 | A * | 8/2000 | Hamilton | 473/452 |
| 7,090,599 | B2 * | 8/2006 | Hedgepath | 473/452 |
| 7,335,117 | B2 * | 2/2008 | Reason-Kerkhoff | 473/452 |
| 2005/0143200 | A1 * | 6/2005 | Hedgepath | 473/452 |
| 2005/0143201 | A1 * | 6/2005 | House | 473/459 |
| 2006/0154220 | A1 * | 7/2006 | Toniolo | 434/250 |
| 2011/0003652 | A1 * | 1/2011 | Brend | 473/452 |
| 2011/0092318 | A1 * | 4/2011 | Torch | 473/452 |
| 2011/0124444 | A1 * | 5/2011 | Uehling, III | 473/459 |

* cited by examiner

*Primary Examiner* — Raleigh W Chiu
(74) *Attorney, Agent, or Firm* — Handal & Morofsky LLC

(57) ABSTRACT

In accordance with the invention, the inventive mat comprises a planar member. A first marking is disposed on the planar member corresponding to the position of the ball of the foot of the first foot at a first swing first point in time during the execution of a first tennis swing. The first swing first point in time is relatively proximate to the commencement of the execution of the first tennis swing. The first foot is the right foot of a right-hand dominant player or the left foot of a left-hand dominant player practicing a two-handed backhand. The first marking may comprise an indication of the sole of a first shoe and indicate the placement of the heel of the first shoe. A second marking is disposed on the planar member corresponding to the position of the sole of the second foot at the first swing first point in time during the execution of the first tennis swing. A third marking is disposed on the planar member corresponding to the position of the first foot at a first swing second point in time during the execution of the first tennis swing. The second marking corresponds to the position of the second foot at the first swing second point in time during the execution of the first tennis swing. The first swing second point in time is after the first swing first point in time.

2 Claims, 15 Drawing Sheets

Two Handed Backhand
Phase 3

Two Handed Backhand
Phase 3

Two Handed Backhand
Phase 3

Two Handed Backhand
Phase 3

Two Handed Backhand
Phase 4

Two Handed Backhand
Phase 4

Two Handed Backhand
Phase 4

Two Handed Backhand
Phase 4

Two Handed Backhand
Phase 3

Two Handed Backhand
Phase 5

Two Handed Backhand
Phase 1

Two Handed Backhand
Phase 4

Two Handed Backhand
Phase 6

Set Position Loading Backleg Forehand
Phase 1

Set Position Loading Backleg Forehand
Phase 1

Set Position Loading Backleg Forehand
Phase 1

Set Position Loading Backleg Forehand
Phase 1

Core Turn Forehand
Phase 2

Core Turn Forehand
Phase 2

Core Turn Forehand
Phase 2

Finish Swing Forehand
Phase 5

Finish Swing Forehand
Phase 5

Finish Swing Forehand
Phase 5

Finish Swing Forehand
Phase 5

VIDEO-BASED SYSTEM FOR TENNIS TRAINING INCORPORATING MATS

TECHNICAL FIELD

The invention relates to apparatus and methods for training athletes in the sport of tennis.

CROSS REFERENCE TO RELATED APPLICATIONS

This application is related to U.S. patent application Ser. No. 12/623,177 filed substantially concurrently with this application and directed to Video Based System for Tennis Training, now abandoned.

STATEMENT REGARDING FEDERALLY SPONSORED RESEARCH OR DEVELOPMENT (Not applicable)

BACKGROUND OF THE INVENTION

The teaching of proper form, in the sport of tennis, is of recognized importance. While many books illustrate proper placement of the feet, arms and legs during the execution of various tennis swings, repeatability and uniformity may be difficult to achieve.

The importance of form in the sport of tennis, as compared to other sports, stems from its presentation of a unique set of physical, temporal and mental challenges. More particularly, in tennis, the ball is in play between opposing players who are located at relatively close distances. This challenge is compounded by the speed with which a tennis ball is put into play and the range of movements available to the opposing player including direction, speed, spin and so forth. At the same time, compared to, for example, paddle tennis, the physical requirements, both in terms of strength and endurance, of the sport are substantial. All of these factors plus the rapid pace of the game underline the need for good form, which tends to conserve energy and maximize the impact of a swing, by making statistically likely to be successful movements reflexive responses which are moderated or varied in the execution to accommodate the particular objectives associated with a particular swing.

Notwithstanding the fact that, over the years, there has been a great emphasis on teaching proper form, effective training aids are not employed. The problem is complicated by the diversity of playing styles and other factors.

SUMMARY OF THE INVENTION

Effective tennis training, unlike training in baseball, golf, badminton and other sports using a device (such as a bat, club or racket) to hit the ball or other object in play, requires a training regimen which is highly rigorous. While existing training systems such as those disclosed by Fishman et al. (US Patent Application Publication No. US 2002/0064764 A1) implement relatively sophisticated options, such as multimedia analysis systems utilizing at least one video camera for acquiring video data of a student player's performance and storage of the same followed by replay of the same and, optionally, more sophisticated options, basic issues respecting the instruction of the student in proper positioning and movement during the execution of the swing are unaddressed.

The present invention addresses the problem with the recognition that repeatability, flexibility, simplicity and adaption of the system to a particular player are an important aspect of training in tennis.

The inventive system achieves the above objectives using a mat which can accommodate a wide range of player motions and swings for a wide variety of players and allow an exceptionally simple and effective matching of the system to particular player characteristics, thus making the inventive training mat simple to use, but nevertheless effective.

In accordance with the invention, the inventive mat comprises a planar member. A first marking is disposed on the planar member corresponding to the position of the toe or ball of the first foot at a first swing (e.g., two handed backhand) first point in time during the execution of a first tennis swing, the first swing first point in time being relatively proximate to the commencement of the execution of the first tennis swing. The first foot is the right foot of a right-hand dominant player or the left foot of a left-hand dominant player practicing two-handed backhand. A second marking is disposed on the planar member corresponding to the position of the sole of the second foot at the first swing first point in time during the execution of the first tennis swing. A third marking is disposed on the planar member corresponding to the position of the first foot at a first swing second point in time during the execution of the first tennis swing. The second marking corresponds to the position of the second foot at the first swing second point in time during the execution of the first tennis swing. The first swing second point in time is after the first swing first point in time.

A fourth marking may be disposed on the planar member corresponding to the position of the sole of the first foot at a second swing first point in time in the execution of a second tennis swing. The second swing first point in time is proximate the commencement of the execution of the second tennis swing. The second marking corresponds substantially to the position of the heel of the first foot at the second swing first point in time in the execution of the second swing. The fourth marking extends from and is oriented in a direction opposite the direction of the second marking and the fourth marking may be a mirror image of the second marking. The fourth marking may be proximate the second marking. A fifth marking may be disposed on the planar member corresponding to the position of the ball of the second foot at the second swing first point in time. A sixth marking may be disposed on the planar member corresponding to the position of the second foot at a second swing second point in time during the execution of the second swing. The fourth marking corresponds substantially to the position of the sole of the first foot at the second swing and second point in time in the execution of the second swing.

In accordance with the invention, a specialized facility may be used. More particularly, in accordance with the invention, the inventive system comprises a first plurality of cameras disposed around a first point in a practice area to generate a plurality of first images of an individual positioned at the first point in the course of the execution of a swing by the individual. A second plurality of cameras is disposed around a second point in a practice area, the second point being displaced from the first point. The second plurality of cameras may be symmetrically positioned with respect to the first plurality of cameras about an axis defined by the position of a first theoretical line positioned between the first and second plurality of cameras, and transverse to a second theoretical line extending between the first and second plurality of cameras. The second plurality of cameras generating a plurality of second images of an individual positioned at the second point in the course of the execution of a swing by the individual. The inventive mat is placed in the practice area at a position below that imaged by the cameras, in order to guide the movements of an individual practicing tennis swings.

The practice area may be a tennis court. The system may further comprise indicia for indicating the position where a person being trained is to stand. It is contemplated that the swing is associated with a range of likely trajectories for a ball being swung at and hit, the cameras in the first and second plurality of cameras being positioned outside the space defined by the likely trajectories.

The practice area comprises a surface marked with lines defining a tennis court and a net dividing the court into two areas. The first plurality of cameras is disposed on one side of the net and the second plurality of cameras being disposed on the other side of the net.

The practice area comprises a surface marked with lines defining a tennis court and a net. The tennis court having a real or imaginary line dividing the court into two areas. The line extending between the two areas and oriented to transverse the net. The first plurality of cameras is disposed on one side of the line. The second plurality of cameras is disposed on the other side of the line. The first plurality of cameras is disposed on the same side of the net as the second plurality of cameras.

The first plurality of cameras may comprise a camera positioned above the first point. The second plurality of cameras may comprise a camera positioned above the second point and wherein the first plurality of cameras comprises a camera positioned to the side of the first point. The second plurality of cameras may comprise a camera positioned to the side of the second point.

The first plurality of cameras may comprise a camera positioned above the first point. The plurality of cameras may comprise a camera positioned above a second point. The first plurality of cameras may comprise a camera positioned on two sides of the first point. The second plurality of cameras may comprise a camera positioned on two sides of the second point.

The cameras may comprise video cameras or still cameras.

The practice area may comprise a court surface and the points may be defined by demarcations of foot positions disposed over the court surface.

The inventive apparatus may further comprise a video recorder for recording the output of one or more of the cameras and, simultaneously or after a period of time, playing back the recorded video and/or still video images.

BRIEF DESCRIPTION THE DRAWINGS

The operation of the invention will become apparent from the following description taken in conjunction with the drawings, in which:

FIGS. 25-28, 29-31, 32-35, 36-39 and 40-43 illustrate, respectively, successive positions in the execution of a forehand;

Figure 24:
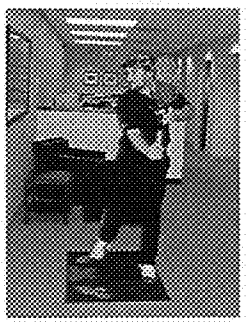
FIG. 24 illustrates the set position for the one handed backhand.
Figure 48:
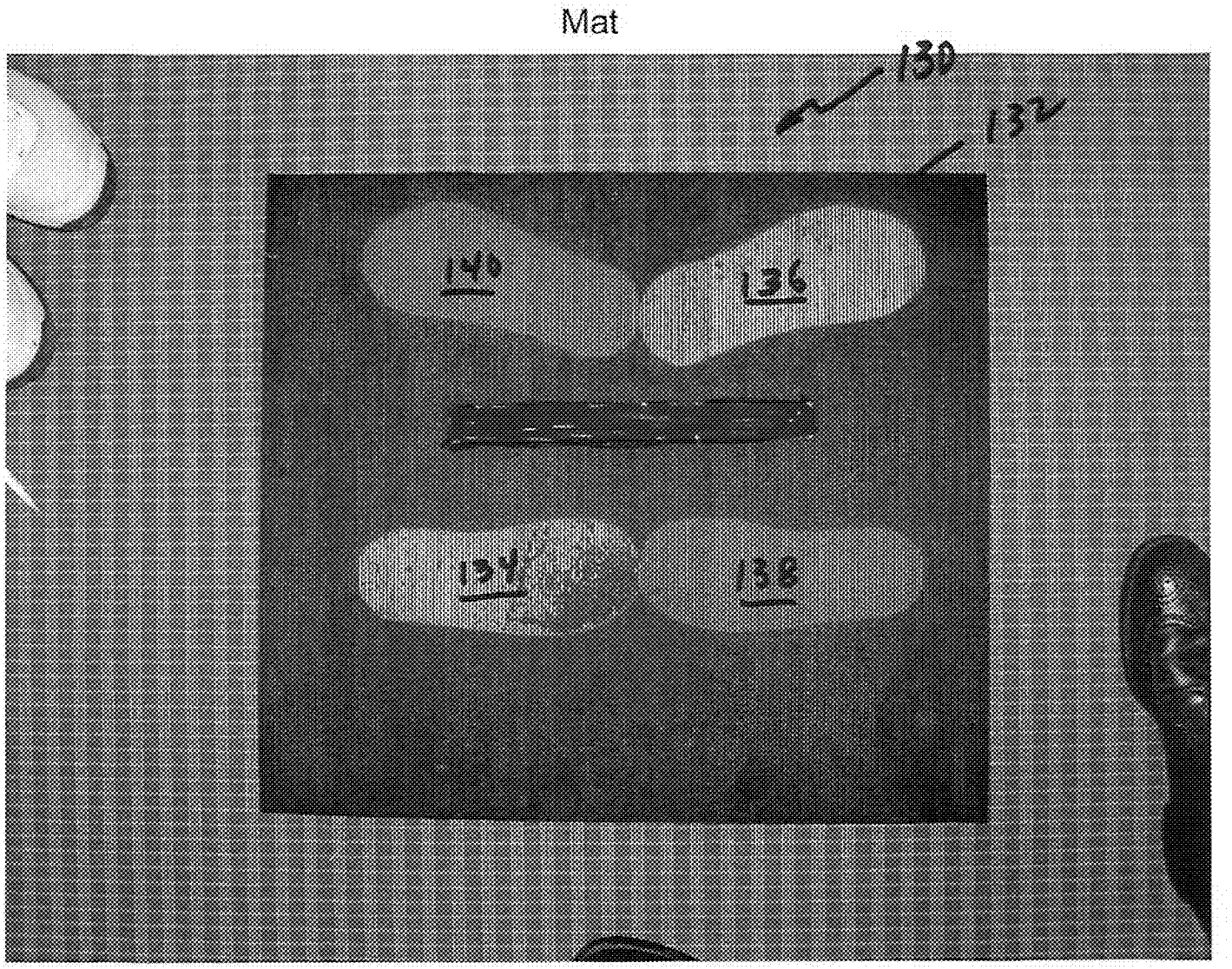

FIGS. 44-47 along with FIG. 24 illustrate successive positions in the execution of a one-handed backhand using the inventive mat;

FIG. 48 illustrate in plan an alternative inventive mat for teaching an individual to execute a serve in tennis; and FIGS. 49-54 illustrate successive positions in the execution of the training of a serve using the mat of FIG. 48.

DETAILED DESCRIPTION OF THE PREFERRED EMBODIMENTS

Figure 1:
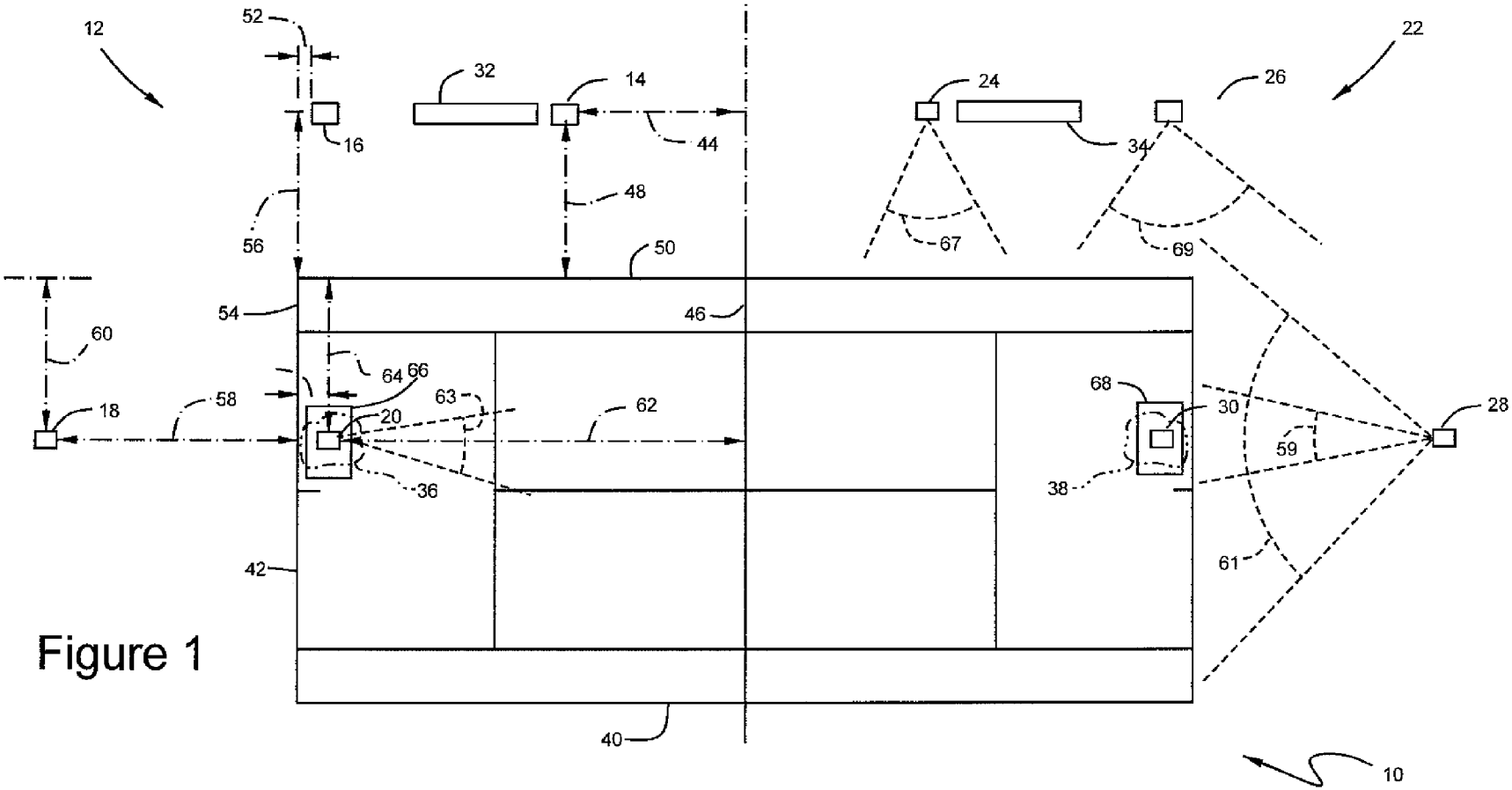
FIG. 1 is a plan view of a tennis training facility which is exemplary of a facility in which the inventive that may be used.

In accordance with the invention, the inventive mat may be used on any tennis court, as well as in a specialized training facility, such as a video monitored court. Turning to FIG. 1, the inventive mat 1 is illustrated in use in a video monitored court 10. Court 10 features a first array 12 of cameras. Array 12 comprises cameras 14, 16, 18 and 20. The inventive video monitored court 10 also comprises a second array 22 of cameras. Array 22 comprises cameras 24, 26, 28 and 30. Cameras 14-20 and 24-30 may be of any standard quality, for example, a common no-frills video camcorder of the type conventionally sold to consumers at retail electronics outlets and typically ranging in cost from about $200-$500. However, a higher quality video camera with high resolution is preferred, mostly from an aesthetic standpoint, although high resolution will also achieve a finer comparison in evaluation of player movement. Such a comparison and evaluation of player movement is of particular value in a number of cases, for example, in the case of relatively advanced players. Such a higher level of performance is also of particular value where a player's performance at a particular point in time is being compared to earlier performance by the same player.

In accordance with the invention, array 12 is provided with a monitor 32. In similar fashion, array 22 is provided with a monitor 34. In accordance with the invention, it is further contemplated that player evaluation will be conducted while the player is on the court and that the player will be informed respecting the nature of his movement and then be allowed to, perhaps repeatedly, view that movement, sometimes overlaid with that of a standard performance done by a highly skilled player, or, at other times, overlaid with an earlier performance of the same player to evaluate changes in player movement. In accordance with the invention, it is contemplated that such changes in a player's style may be of a positive or negative nature, or may point the direction for future development.

Optionally, there may only be one monitor for the whole court placed in the corner or in the middle of the court on the side wall.

In accordance with the invention, it is contemplated that the system may incorporate more than one monitor. In this case, it may be advantageous for both monitors to be showing the same images of the individual who is being trained. In accordance with the invention, it is further contemplated that while, in principle, more than one or two images may be displayed on the screen, given the limitations and the size of the screen, sending two images to the screen at one time offers good imaging of the person practicing. Likewise, if desired, a single image may be used from any one of the eight cameras in the system. The provision of images to a monitor is largely a function of obtaining a relatively comprehensive picture of good quality subject to user preferences. Likewise, as larger screens become economically available, more than two images may be displayed simultaneously with high quality. Finally, a single monitor may be used. Unlike the cameras, it is contemplated that the monitor or monitors may be moved to accommodate easy viewing during the employment of the invention in a teaching exercise. For example, a monitor may be positioned where the student is naturally facing while performing a training exercise.

While a wide range of monitor sizes may usefully be employed, in accordance with the present invention, it is contemplated that relatively large monitors are to be employed. Monitors 32 and 34 may, for example, have a standard diagonal measurement of 42 inches (or smaller but preferably larger) and are sufficiently large for a player to easily enough view movements and receive instruction while he is using the inventive video monitored court 10.

Similarly, a wide range of monitor technologies may be employed. More particularly, monitors 32 and 34 may use, for example, plasma technology. Generally, currently plasma technology is believed by the inventor to be of superior value in the implementation of the invention, because of the very large screen sizes that can be achieved by plasma technology. However, given that liquid crystal technology can produce screens in the 46 inch (115 centimeters) range, it is expected that the brighter output or other advantages of liquid crystal screens (and perhaps other technologies) will make them increasingly effective, as the technology is implemented in larger size and brighter displays.

It is also preferred that monitors 32 and 34 be protected from mechanical impacts, for example, tennis balls which stray to the sides of court 10. Video monitors 32 and 34 may be housed in a protective cage made of clear transparent plastic, heavy gauge wire or metal rod stock. Alternatively, a shield of clear transparent plastic, for example plastic having a thickness of a 1.25 cm, may be used to protect the monitors.

Bright displays are of value because tennis is often played under bright lighting conditions, including direct sunlight. However, in accordance with the invention, it is contemplated that the inventive video monitored court 10 most often would be deployed in an indoor configuration. However, the invention is equally applicable to deployment outdoors.

The configuration of the inventive system for two trainee positions 36 and 38 is illustrated in FIG. 1. The inventive arrangement of cameras is deployed on a tennis court of conventional dimension.

Camera 14 is positioned at a distance 44 of about, for example, 18 feet in front of net 46 and a distance 48 of, for example, 6-12 feet to the left of length 50 (the "doubles line"), of the court. Camera 14 is positioned at a height of roughly, for example, about 78 inches above the surface of the court (although a wide range of heights will work adequately) and aims, for example, at the net at an area adjacent and on the same side of the net as a person being trained, at a point approximately 34 inches above the surface of the court, roughly corresponding to a point approximately at the waist of the person using the inventive court 10. Such a person working at the net may be working on his transition game or his volleys and overheads.

Camera 16 may be positioned at a distance 52 of one foot in front of the baseline or width 54 of the court and a distance 56 of about six to twelve feet, for example, to the left of length 50 of the court. Camera 16 is positioned at a height of roughly about 78 inches above the surface of the court and aims generally at player position 36 at a point approximately three feet above the surface of the court, roughly corresponding to a point approximately at the waist of the person using the inventive court 10. In accordance with the invention, it is contemplated that the player will be centered in the center of the monitor. More particularly, it is contemplated that the monitor will display the player centered on the screen with an area above and below the player. The area above the player visible on the monitor will be about four or five feet above the player, being generally determined by the height needed to fully show the motion of the server and his racquet, as well as the path of the ball. The area below the player on the screen may be relatively small but large enough to ensure that during the entire movement the feet of the player are seen on the screen.

Camera 18 is positioned at a distance 58 of, for example, roughly 15 to 25 feet in front of baseline 42 at a distance 60 of, for example, roughly ten to fourteen feet to the right of length 50 of the court. Camera 18 is positioned at a height of, for example, eight to twelve feet above the surface of the court and aims directly at player position 36, centered, for example, at a height, for example, roughly about three feet above the surface of the court where the player is standing, roughly corresponding to a point approximately at the waist of the person using the inventive court 10. In accordance with the invention, it is contemplated that the cameras will use wide angle lenses, although narrower lenses, for example lenses having a field of view of approximately 40° or 80°, for example may be used. This means that the viewing area associated with, for example, camera 28 would vary from approximately twice the angular width 59 of the student to the full angular width 61 of the court baseline. Likewise, camera 26 is selected to have a field of view which encompasses expected ranges of position for the player during the particular exercise.

Camera 20 is positioned at a distance 62 of roughly about 35 to 37 feet in front of net 46 and a distance 64 of roughly about 10 to 14 feet to the right of length 50 of the court. Camera 20 is positioned at a height of roughly about 20 to 30 feet above the surface of the court, as may be permitted by the height of the ceiling of the facility, and aims directly down at player position 36. Alternatively, it may be aimed directly across to the opposing side and the position 38 occupied by a student on the other side of the net and have an angular width 63. In accordance with the invention, it is contemplated that the mat will be put in the illustrated position in the case of instruction of younger players. In the case of more advanced players, it is expected that the mat will be put outside the baseline of the court, typically in a position where a player is located when hitting groundstrokes during a game. Moreover, the mat is less relevant, if at all, to use during the training of high performance high level players.

Optionally, the inventive video-monitor court 10 may be provided with an area demarcation 66 which may be tape, paint or other indicator applied to the surface of the court. Another option is for area demarcation 66 to take the form of a mat with a plurality of foot position indicators which are used to guide the student being trained in the execution of particular shots. Such mats are described in the above-referenced co-pending related applications, the disclosures of which are hereby incorporated herein by reference.

However, there is no need to have a student limited to practicing at a single position since a wide angle lens will be able to capture a large area and record the same. In this regard overlays of images may be varied, in position to correct for positional variation, for example, when comparing two performances.

Cameras 24, 26, 28 and 30 are associated with the area demarcation 68, which may be a simple rectangle or a mat or footprint demarcations printed or adhered to the surface of the court, as may be the case with respect to area demarcation 66. If a mat is not being used the student can simply locate himself looking in the monitors, however it is preferred that a marking be included in the inventive court in order to have uniformity in the display of players by using the same player position and same camera position. Area demarcation 68 provides an optimized viewing position for certain swings with respect to which training may not be appropriate with the player position over area demarcation 66. Accordingly, as we discussed in detail below, area demarcation 66 and 68 are particularly valuable in connection with training of certain shots which training depends upon whether the student being trained is right-hand dominant or left-hand dominant. The result is a highly efficient and effective training method.

Camera 24 may have an angular field of view 67, while camera 26 may have an angular field of view 69.

Returning to FIG. 1, the positions of cameras 24, 26, 28 and 30 are disposed in a mirror image with respect to cameras 14, 16, 18 and 20, respectively, and are symmetrical about net 46. Cameras 24-30 are positioned at the same height as cameras 14-20 respectively and are also aimed a little above the waist of the player. For example, camera 24 is positioned at a distance about, for example, 18 feet in front of net 46 and a distance of about, for example, 6 to 12 feet to the right of the doubles line of the court. Camera 24 is positioned at a height of 78 inches above the surface of the court and aims perpendicular to the doubles line to, for example, photograph a player standing in front of it and in its field of view at a point approximately three feet above the surface of the court, roughly corresponding to a point approximately at the waist of the person using the inventive court 10. In accordance with the invention, it is also contemplated that camera 30 may be used to video a player in position 38, as a variation of the embodiment disclosed above, if that is desired by the individual using the system.

During use, the student is positioned, for example for the case of a young student, in position 36 or 38, as is appropriate. More advanced players may be positioned further from the net. The student may throw a ball up in the air or bounce a ball to allow the student to practice a shot during the videoing of the student's movement. Alternately, a ball pitching machine may be used. After the student has practiced swinging a tennis racket, an instant replay may occur on the monitor that is closest to the student in order for her to see her performance and receive guidance from the instructor.

In accordance with a preferred embodiment of the invention, a tennis player, for example a professional tennis player whose form is to be emulated, performs swings and is videoed in the inventive court 10. Such videos would be generated for a plurality of different swings.

After a student being trained performs a particular swing, the video of the professional player doing the same swing is played, optionally superimposed over and synchronized to the swing of the student. This enables the student to see differences and perhaps better understand how to improve performance.

In accordance with the invention, it is contemplated that particular advantage can be achieved by the generation of mirror images of the performance of the swing by the professional player. For example if a student being trained is left-hand dominant and the professional player is right-hand dominant, a mirror image video of the professional player may be superimposed on the video of the student's swing.

Optionally, after the student being trained performs a particular swing, a videotape of that student's own swing can be played and superimposed to show changes in the style of the student, perhaps good changes or perhaps changes which represent a deterioration in performance.

In accordance with the invention, it is also contemplated that a trainer may choose to show the video to the student prior to the student's execution of a particular swing in order to provide some general guidance to the student. In such event, the use of mirror images of players of opposite hand dominance may be used, and the proper orientation of the same provides a lower mental overhead and thus ease of use as compared to merely looking at a video of a professional player to be emulated.

In all of the above examples, the uniformity provided by having a fixed position of play and fixed cameras, which are fixed during the time that the student is using the inventive court 10 and are in the same positions when the professional player to be emulated is generating the training videos used in the system, provides significant advantages. Likewise, the student at an earlier point in time would have assumed the same position facilitating assessment of his swing at a later point in time. Uniformity in student and player position can be achieved by placing a player position marking on the court.

Likewise, because the system may be used by both right hand dominant and left-hand dominant players, the provision of symmetrical camera arrangements allows the transposition of left-handed training to right-handed students and vice versa.

Moreover, enhanced accuracy in the inventive system may be achieved through the use of mats which include demarcations, for example printed demarcations, indicating positions for the feet showing various portions of particular tennis swings.

In accordance with the invention, it is contemplated that certain swings would be performed in different positions depending upon the particular swing being practiced and whether the individual is right-hand or left-hand dominant.

For example, player position 36 would be appropriate for filming of both students being trained and professionals to be emulated when performing a backhand, a backhand volley, backhand overhead, and a backhand approach shot, provided that the players are right-hand dominant.

Conversely, player position 38, for right-hand dominant students being trained and right-hand dominant professionals to be emulated, is appropriate for training an overhead swing, a forehand volley, a forehand approach shot, a serve, and a forehand. During filming and training, they should be positioned, for example, over demarcation area 68 or other positions as appropriate for the swing being practiced.

For left-hand dominant players, who should be positioned, for example, over a demarcation area 66, player position 36 is appropriate for filming of both students being trained and professionals to be emulated when performing a forehand, a serve, an overhead, a forehand approach swing and a forehand volley.

Conversely, left-hand dominant players may be trained at player position 38 for a backhand swing, a backhand overhead, a backhand approach swing, and a backhand volley.

In accordance with the invention, it is contemplated that the positions of the cameras may be controlled electronically, for example, in response to a remote control or other console. Alternatively, software may be used to control camera orientation to automatically determine proper viewing angle and zoom setting (i.e. focal length).

It is also noted that the control of the cameras may be varied between an adult and a junior orientation, or perhaps an adult, junior and young junior orientations.

The possibility also exists to use artificial intelligence software to convert existing images to images standardized to the system, thus allowing comparison with players who have not performed at the standardized inventive court.

Similarly, artificial intelligence software may be provided to adjust the position, orientation and zoom setting of the cameras to emulate the position, orientation and focal length of a camera with which existing footage was taken. In connection with this, the positions of the cameras including their position, orientation and focal length may be computer-controlled using a robotic arm, track system or other mechanical artifice.

In accordance with the invention it is also contemplated that the position of the cameras may be varied by computer during the practicing of different swings, with the objective of optimizing the display of the position of the person being videoed, but at the same time keeping the position of the cameras during the reference video, whether it be that of a professional to be emulated, or the person being trained at another time. Such camera positions may be stored in memory to allow maximum flexibility in the system and the ready use of prerecorded swings.

The use of the inventive video monitored tennis training court 10 may be better understood with reference to its use by a right-handed player practicing a backhand swing.

Figure 2:
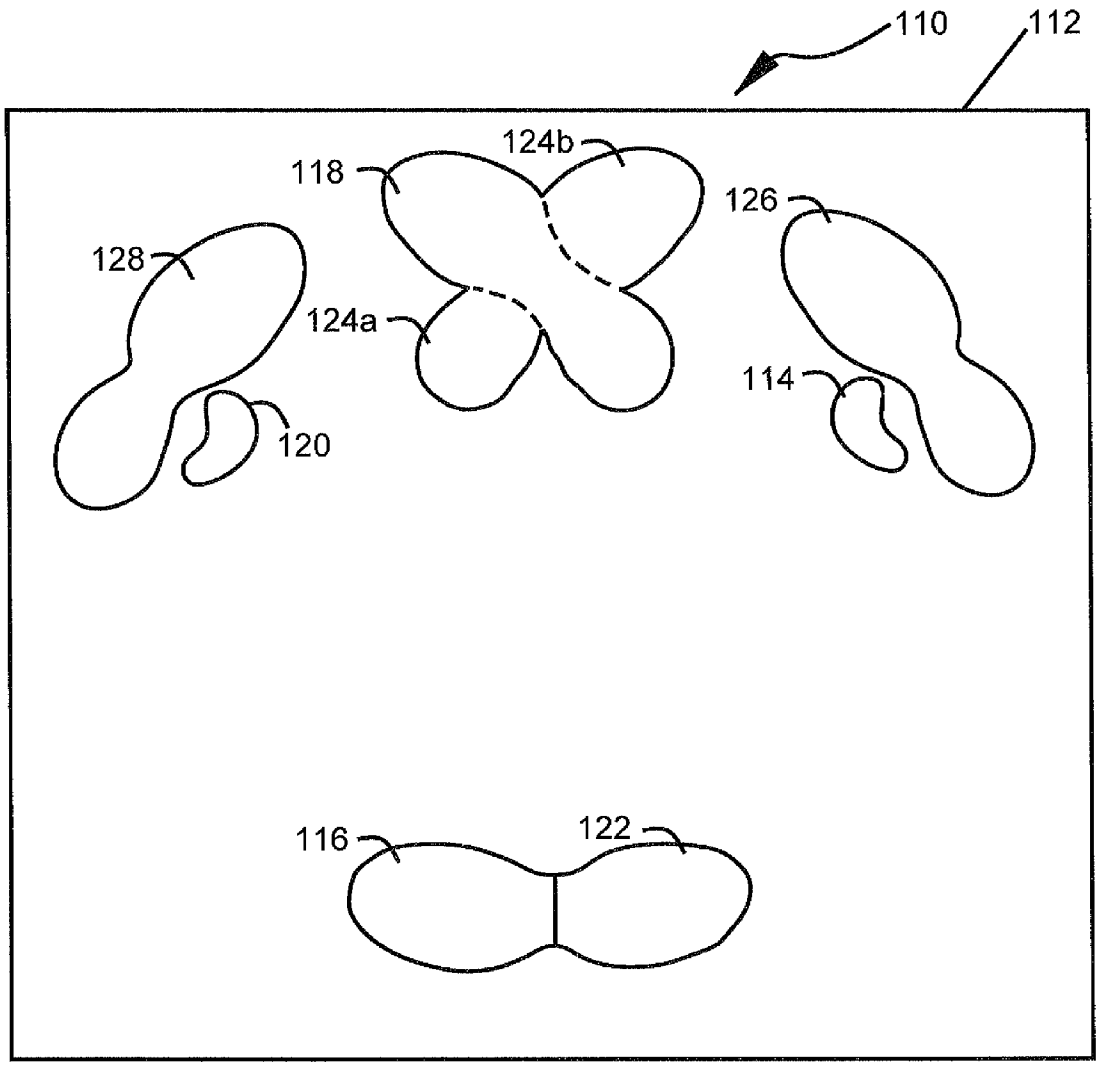
FIG. 2 is a plan view of the inventive mat.
Figure 3:
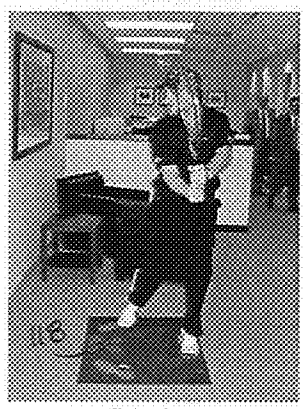
FIGS. 3-7 illustrate a first position in the execution of a two-handed backhand using the inventive mat.
Figure 4:
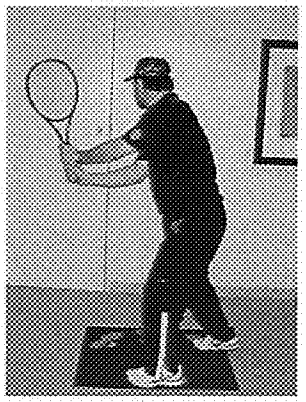
Figure 5:
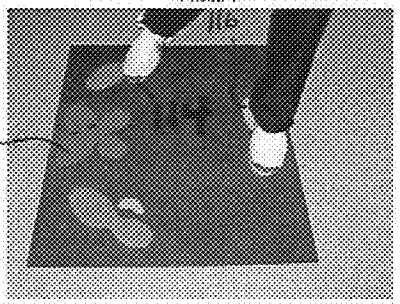
Figure 6:
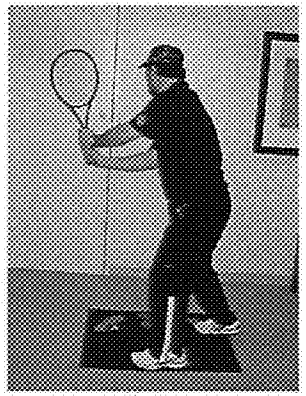
Figure 7:
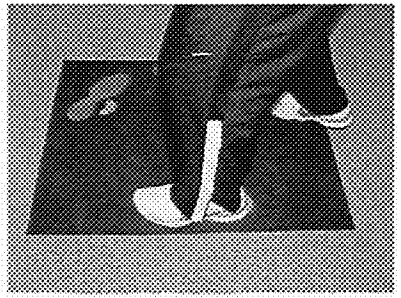
Figure 8:
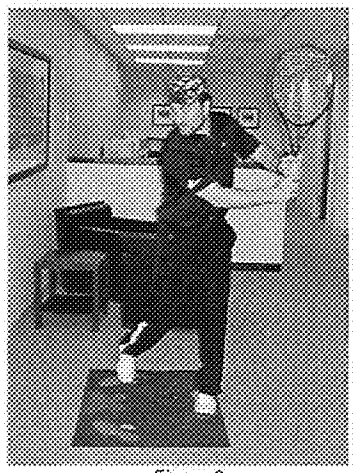
FIGS. 8-11, 12-15, 16-19 and 20-23 illustrate successive positions in the execution of a two-handed backhand using the inventive mat.
Figure 9:
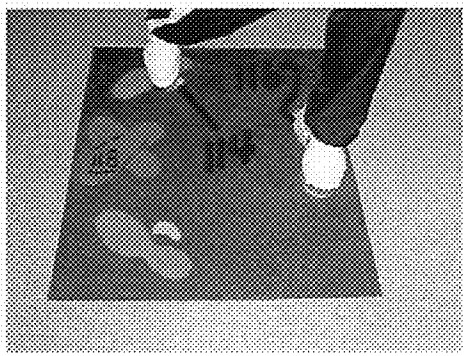
Figure 10:
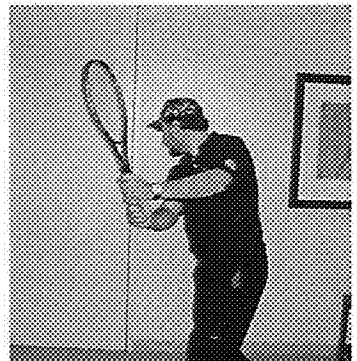
Figure 11:
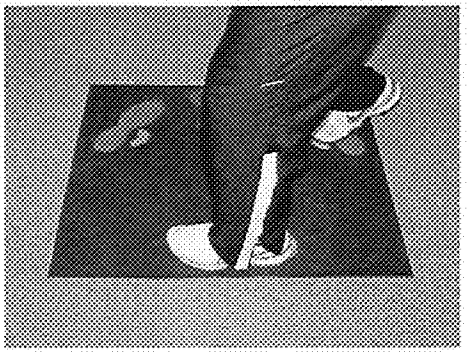
Figure 12:
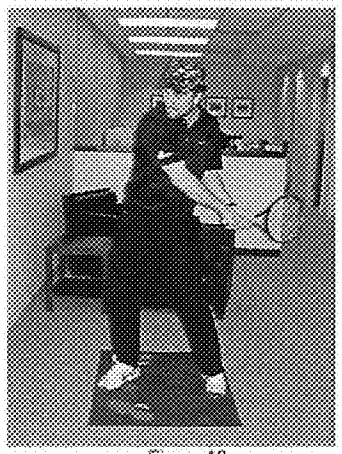

Turning to FIG. 2, the use and construction of mat 110 may be understood. More particularly, the apparatus and method of the present invention may be better understood by illustrating the use of mat 110 in conjunction with the execution of practice of a two-handed backhand swing.

As illustrated in FIG. 2, mat 110 comprises a flat planar member 112 with a plurality of markings disposed on it. Planar member 112 may be made of any suitable material, such as sheet plastic, for example vinyl plastic, rubber, fabric or any other suitable material, although flexible materials are preferred, as are materials which provide a suitable surface for playing tennis. Likewise, heavier materials, such as a relatively thick, for example a quarter inch or half-inch sheet of rubber, are most preferred, insofar as, in accordance with the invention, the mat would better tend to stay in place during use.

Marking 114 (a first marking)is positioned on flat planar member 112 in the upper right quadrant of planar member 112 and is generally crescent shaped, corresponding to the shape of the ball of the foot when the tip of the foot is placed on the mat. More particularly marking 114 is oriented with an angular orientation which corresponds to the position of the ball of the foot of the user during the practice of swings which utilize marking 114, as more fully appears below in connection with the description of the execution of practice swings using inventive mat 110. Optionally, marking 114 may be yellow in order to assist direction of the student by an instructor who might instruct the student to place his or her ball of the foot on the yellow mark, or words to that effect. All of the markings may be colored, for example differently, to achieve this end.

Mat 110 also has a marking 116 (a second marking) which has a shape which roughly corresponds to the sole of an individual using mat 110. Optionally, marking 116 may be colored, for example it may also be yellow as markings at 116 and 114 may be used together at the beginning of the execution of certain practice swings.

Mat 110 also has a marking 118 (a third marking) which is generally shaped like a footprint and oriented to receive the right foot of the user when the left foot is aligned using marking 116. It is noted that marking 118 is sized to coincide with the footprint of an adult. Likewise, other markings on mat 110 are similarly sized. In accordance with the invention, it is contemplated that smaller individuals will use smaller practice mats 110. The general proportionality of footprint/toe print, etc. size and overall mat dimensions may be proportionally reduced for smaller individuals whose feet are also smaller. In accordance with the invention, it is contemplated that all elements of the general pattern illustrated in FIG. 2 would be reduced proportionately. For example, a mat 110 meant for a six-year-old may have an overall dimension and individual element dimensions which are 60% those of an adult.

In accordance with the invention, mat 110 may be used to train a two-handed backhand swing. Such training, in the case of a right-handed individual would be achieved, for example, by placing the mat as indicated by demarcation 66 in FIG. 1.

Assuming one is a right-handed individual, when it is desired to practice a two-handed backhand, one begins the exercise by assuming a first position illustrated in FIGS. 3-7. This and the following training swings are exemplary of the use of the inventive mats, which, in accordance with the invention, may be used with other training procedures and methods. More particularly, one places the ball of the foot on mat 110 over marking 114. At the same time, the left foot is positioned on mat 110 with the sole of the foot of the person performing the exercise positioned over marking 116. The individual thus has taken the position illustrated in FIGS. 3-7 from various different points of view.

One then moves to the second position illustrated from various angles in FIGS. 8-11.

Figure 13:
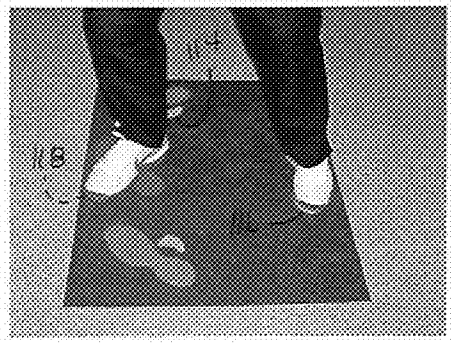
Figure 14:
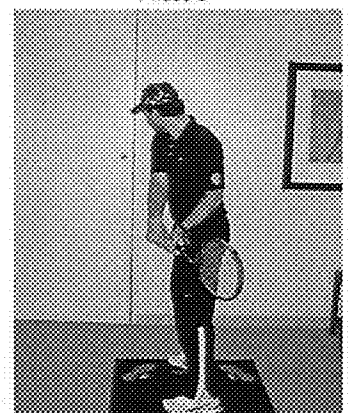
Figure 15:
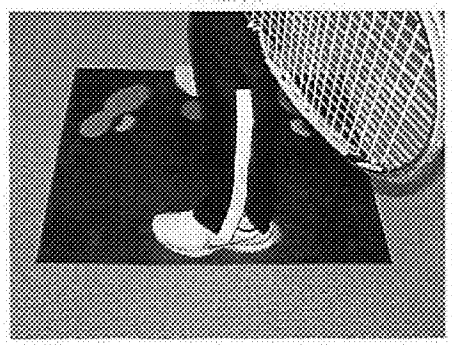

One then moves to the third position illustrated in FIGS. 12-15 from different angles. In this position, the backwards movement of the racket is continued (FIGS. 12 and 15) while the right foot is moved onto marking 118 (FIG. 13).

Figure 16:
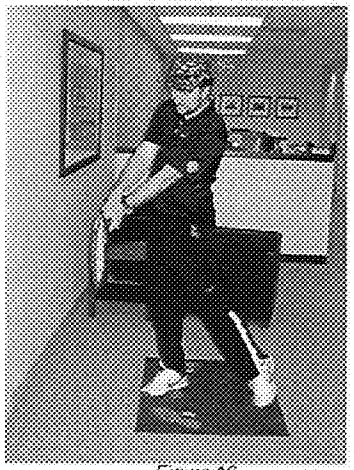
Figure 17:
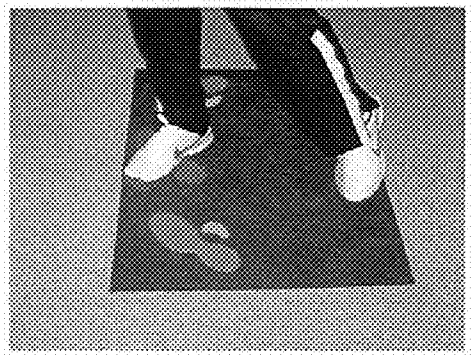
Figure 18:
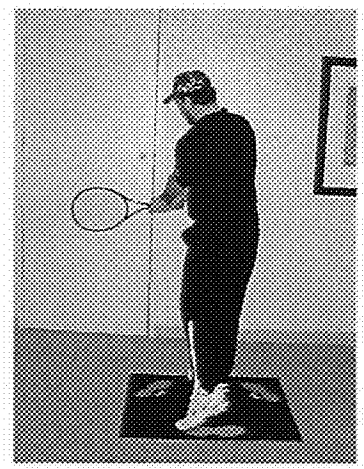
Figure 19:
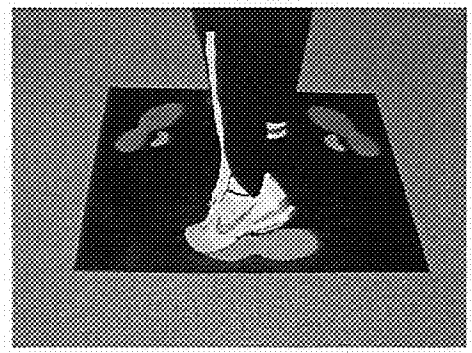
Figure 21:
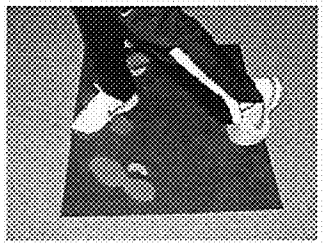

In the fourth position (illustrated in FIGS. 16-19), the heel of the left foot is raised (FIG. 17) during forward movement of the racket to the position illustrated in FIGS. 16 and 18.

Figure 23:
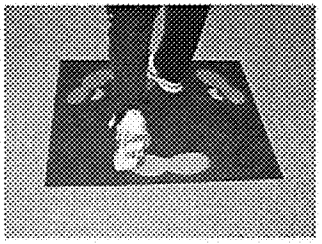
Figure 20:
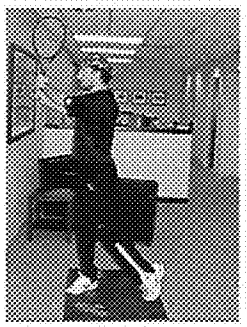
Figure 22:
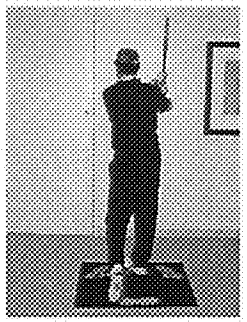
Figure 25:
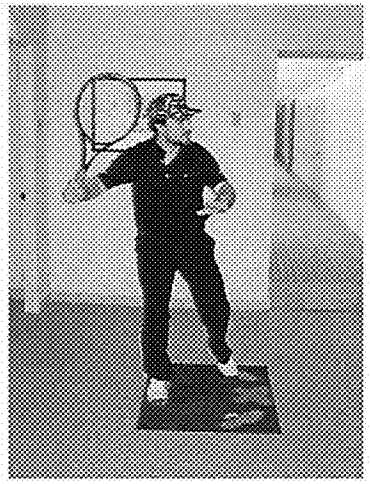
Figure 26:
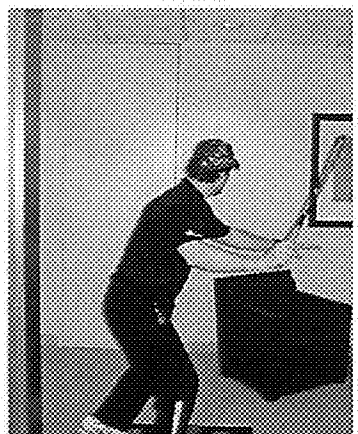
Figure 26:
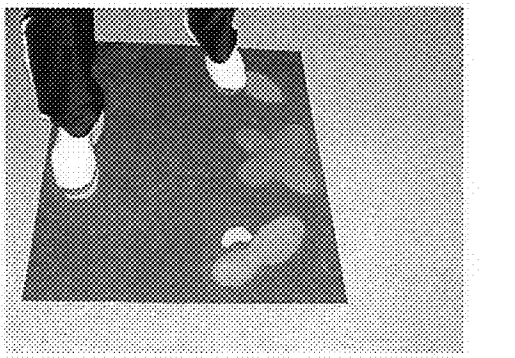
Figure 27:
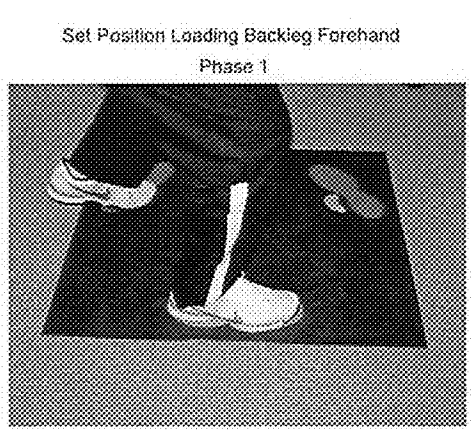

In the fifth position (illustrated in FIGS. 20-23), the movement is continued, thus resulting in a continuous and smooth transition from the first position through the second, then the third and the fourth position and on to the fifth position. More particularly, in transitioning to the fifth position, the heel of the left foot is continued to be raised (FIG. 23). Likewise, the movement of the racket is continued to the position illustrated in FIG. 20.

Referring back to FIG. 2, if the individual is left-handed, the exercise of FIGS. 3-24 is performed in mirror image, using markings 120,(a fifth marking), 122 (a fourth marking), and 124*a* (a part of a seventh marking) and 124*b* (part of the seventh marking).

In accordance with the invention, the inventive mat 110 may be used for a variety of swing training exercises in addition to a two-handed backhand training exercise. For example, it may be used for the one handed back hand as illustrated in FIG. 24 or it may also be used to train the forehand swing.

A right-handed individual then assumes the position illustrated in FIGS. 25-28. This is referred to as the set position in which one shifts one's weight to the right leg. The right foot is positioned with the right ball of the foot over marking 120. At the same time, the left foot is positioned over marking 122. It is noted that mat 110 is positioned opposite the position required for execution of a two-handed backhand.

Figure 29:
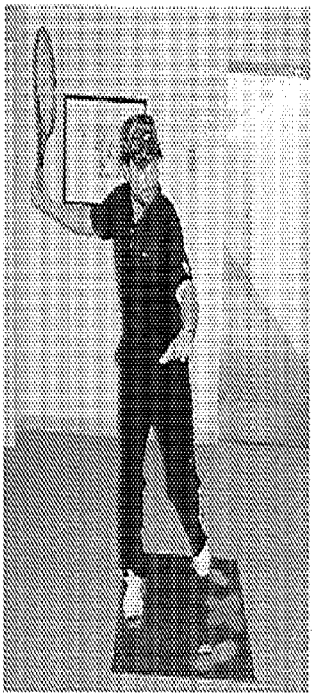
Figure 30:
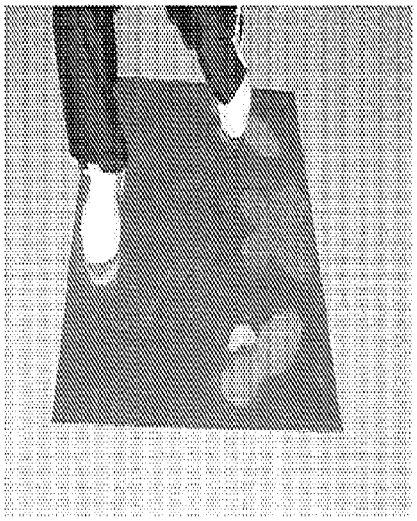
Figure 31:
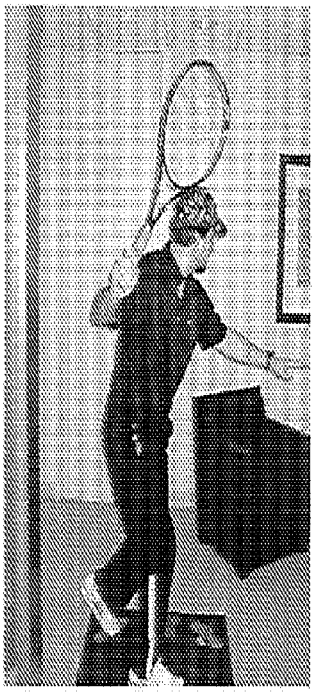

One then pulls the racket back to assume the second position illustrated in FIGS. 29-31. One then proceeds to the position illustrated in FIGS. 32-35 by transferring the whole left foot over marking 128 (a sixth marking) as can be seen most easily in FIG. 33 and moving the racket a bit further back. At the same time, the right foot is moved back to marking 126 (an eighth marking). The racket may then be advanced forwardly with the person being trained moving smoothly to the position illustrated in FIGS. 36-39, where the heel of the right foot is substantially raised while the swing is being executed.

This swing exercise, like all the exercises described herein, may also be done a left-handed person by using the mirror image of the markings on the mat employed in the right handed version of the exercise. In this case, marking 128 would be used by a left-handed person in place of marking 126 as described above.

The swing is then completed by the player moving smoothly to the position illustrated in FIGS. 40-43.

In accordance with the invention, the one-handed backhand may be trained by the player assuming the position illustrated in FIG. 24, called the set position loading the back leg. Then the student assumes the position in FIG. 44. To train this swing, a right-handed individual places his right toes and ball of the foot on marking 114 while resting his left foot on marking 116. The individual then moves to the position illustrated in FIG. 45 where the right foot is moved to marking 118 with the racket being brought back to execute the swing by moving into the position illustrated in FIG. 46 followed by continuation of the movement to the position illustrated in FIG. 47.

In accordance with the invention, a second mat 130, as illustrated in FIG. 48 comprising a planar member 132 is also provided for the purpose of a training exercise to train an individual to do a serve in tennis. A right-handed person uses markings 134 and 136. A left-handed person would use markings 138 and 140. Depending on the aptitude and level of the player, various progressions may be taught by professional tennis instructors.

Figure 49:
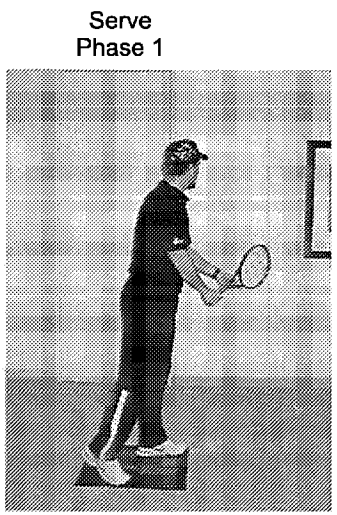
Figure 50:
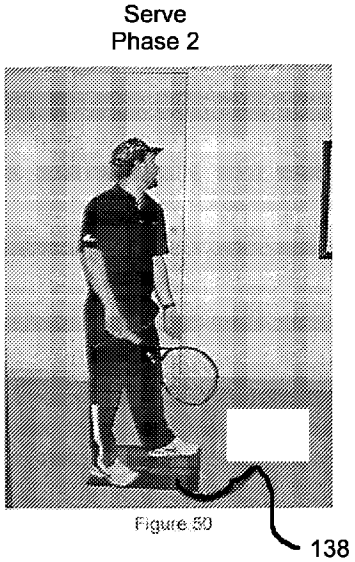
Figure 51:
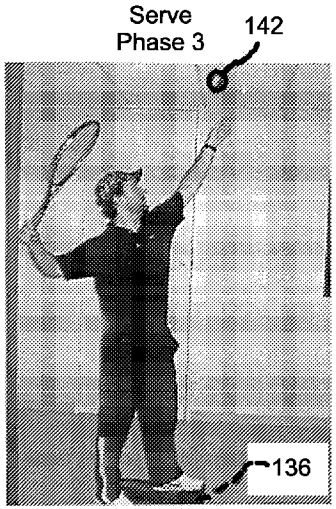
Figure 52:
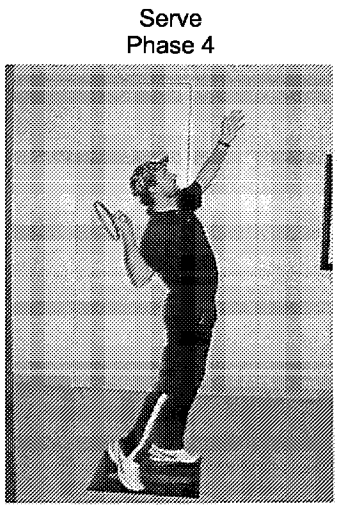

For example, a more advanced student may be trained by initially taking the position illustrated in FIG. 49. In this position, the left foot is positioned over marking 136 substantially with the entire bottom of the foot against the mat. The right foot is positioned within the ball of the foot over the ball of the foot portion of marking 134. During the training exercise, the individual moves from the position illustrated in FIG. 49 to the position illustrated in FIG. 50, where the right heel is advanced toward the heel portion marking 134. The individual then throws the ball 142 upwardly, in the manner of a conventional serve, as shown in FIG. 51. During this motion the hand is brought backwards, as illustrated.

Figure 32:
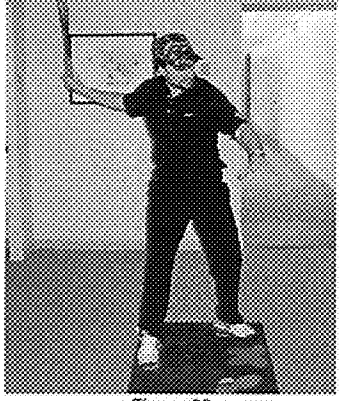
Figure 33:
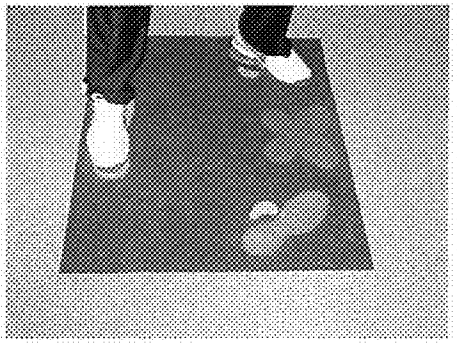
Figure 34:
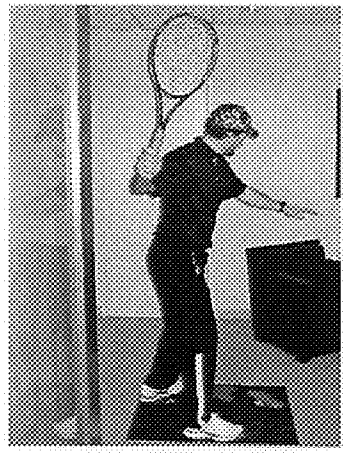
Figure 35:
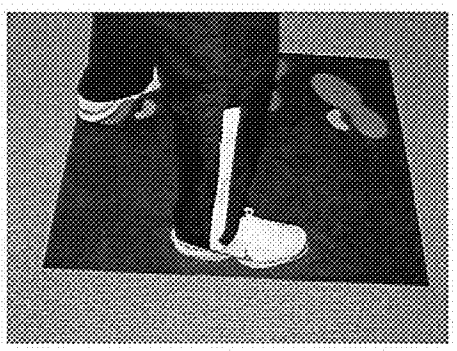
Figure 36:
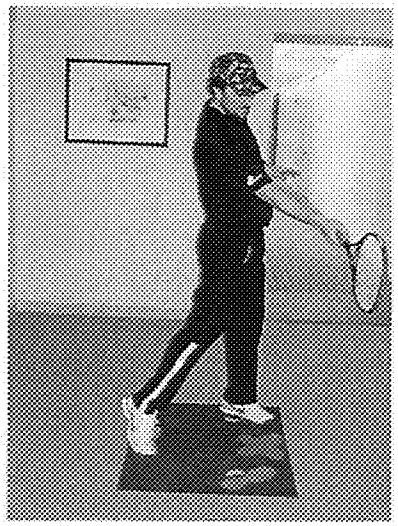
Figure 37:
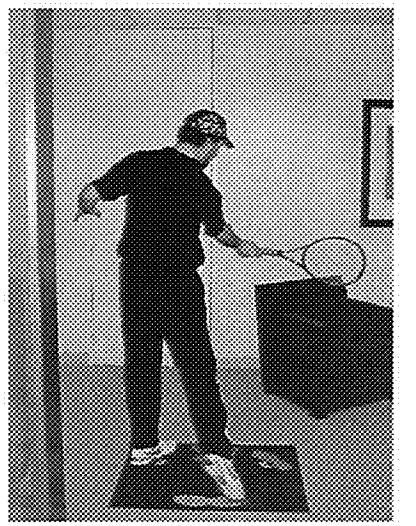
Figure 38:
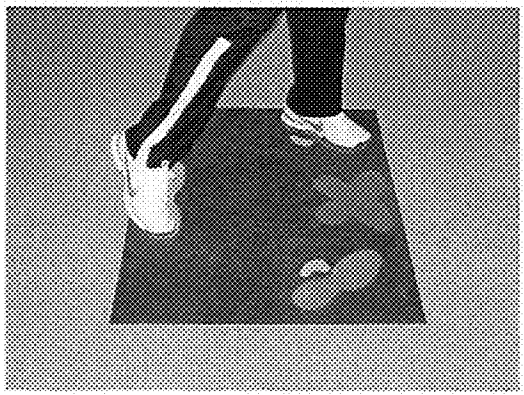
Figure 39:
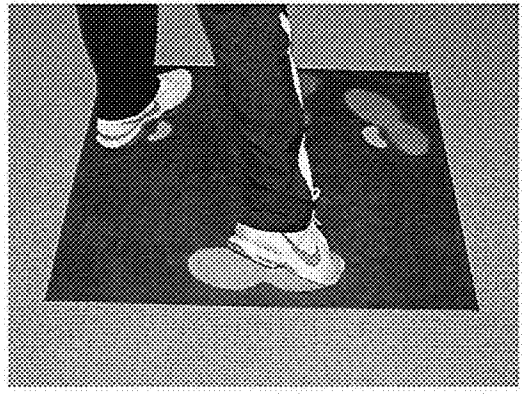
Figure 40:
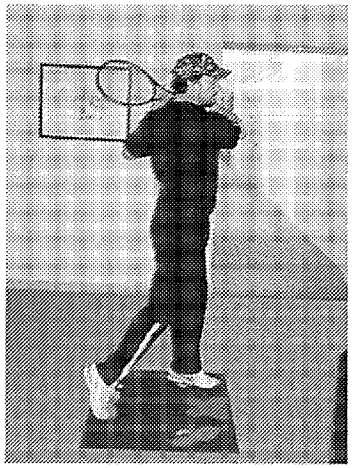
Figure 41:
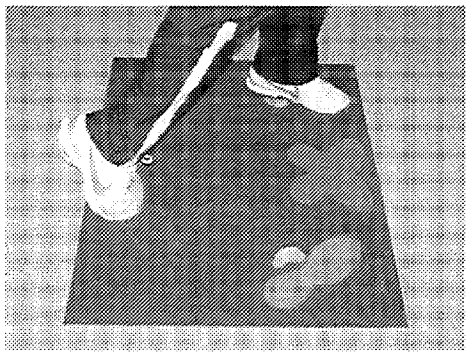
Figure 42:
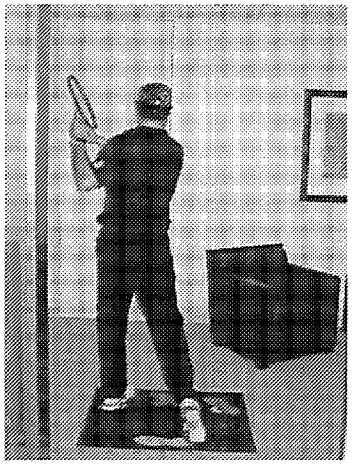
Figure 43:
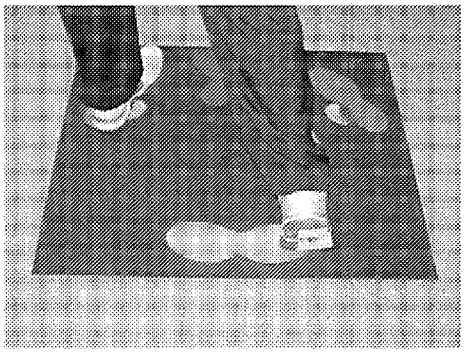
Figure 44:
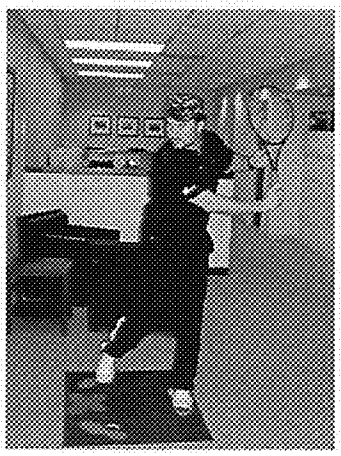
Figure 45:
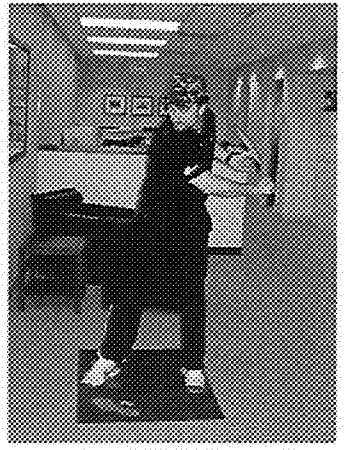
Figure 46:
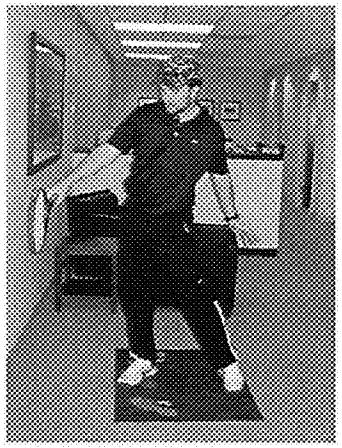
Figure 47:
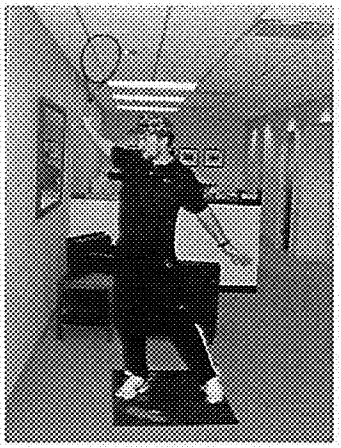
Figure 53:
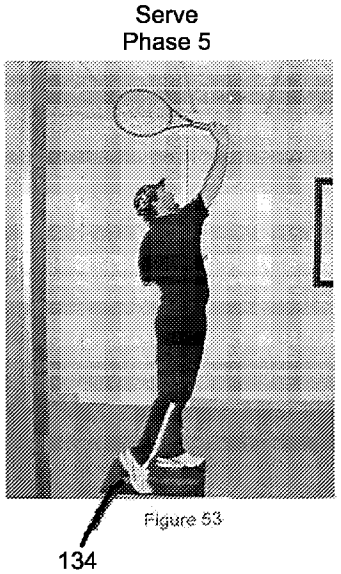
Figure 54:
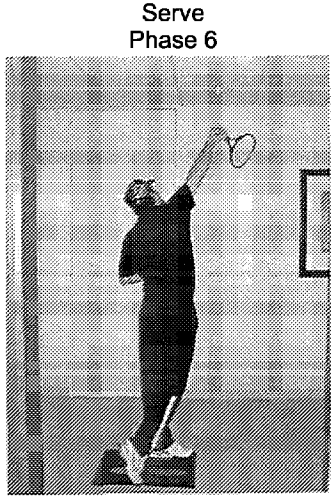

As the ball continues to rise, the individual pulls back the racket with his right hand to the position illustrated in FIG. 32 with the right heel substantially raised and then advances it forwardly through the position illustrated in FIG. 53 through the position illustrated in FIG. 54.

Optionally, markings 136 and 134 may be in one color, while markings 138 and 140 may be in another color in order to provide some differentiation between the markings used by right and left-handed players. Four different colors may be used to facilitate clarity in instruction.

Generally, it is noted that the positions and exercises illustrated substantially conform to existing practice and that the inventive mat provides a means to facilitate and control practice. It is contemplated that the mat may be used by an individual or it may be used by an individual working with a trainer or coach.

While an illustrative embodiment of the invention has been described, variations and modifications of the same will be obvious to those of ordinary skill in the art. Such variations and modifications are within the scope of the invention which is limited and defined only by the appended claims.

What is claimed:

1. Apparatus for training an individual in a swing in the sport of tennis by guiding the placement of first and second feet of an individual being trained during the tennis swing execution through the provision of a plurality of markings supported on a substrate and indicating positions for said first and second feet during tennis swing execution, comprising:

(a) a planar member;

(b) a first marking disposed on said planar member corresponding to the position of the ball of the foot of said first foot at a first swing first point in time during the execution of a first tennis swing, said first swing first point in time being relatively proximate to the commencement of the execution of said first tennis swing, said first foot being the right foot of a right-hand dominant player or the left foot of a left-hand dominant player;

(c) a second marking disposed on said planar member corresponding to the position of the sole of said second foot at said first swing first point in time during the execution of said first tennis swing;

(d) a third marking disposed on said planar member corresponding to the position of said first foot at a first swing second point in time during the execution of said first tennis swing, said second marking corresponding to the position of said second foot at said first swing second point in time during the execution of said first tennis swing, said first swing second point in time being after said first swing first point in time, wherein said planar member comprises a video display and said markings comprise video images.

2. Apparatus as in claim 1 wherein said markings are presented at times which serve to guide the movement and placement of the feet of the individual being trained, said markings comprising a series of images including said markings, said markings being presented in sequence in substantially continuous form, in the form of a motion picture, to guide said individual being trained, and further comprising a video monitor driven by a camera focused on the feet of the individual being trained, and a video display positioned, configured and dimensioned to be viewed by the individual being trained during training, whereby the individual being trained may adjust the position of his feet as indicated by the image of the continuous motion picture images guiding placement of the feet as they appear on the video display.

* * * * *